US009882262B2

(12) United States Patent
Sippel

(10) Patent No.: US 9,882,262 B2
(45) Date of Patent: Jan. 30, 2018

(54) DOMESTIC APPLIANCE HAVING AN ANTENNA

(75) Inventor: Matthias Sippel, Waging am See (DE)

(73) Assignee: BSH Hausgeräte GmbH, Munich (DE)

( * ) Notice: Subject to any disclaimer, the term of this patent is extended or adjusted under 35 U.S.C. 154(b) by 332 days.

(21) Appl. No.: 14/131,466

(22) PCT Filed: Jul. 23, 2012

(86) PCT No.: PCT/EP2012/064392

§ 371 (c)(1),
(2), (4) Date: Jan. 8, 2014

(87) PCT Pub. No.: WO2013/017455

PCT Pub. Date: Feb. 7, 2013

(65) Prior Publication Data

US 2014/0139381 A1 May 22, 2014

(30) Foreign Application Priority Data

Aug. 1, 2011 (DE) ..... 10 2011 080 185

(51) Int. Cl.

| | |
|---|---|
| ***H01Q 1/24*** | (2006.01) |
| ***H01Q 1/22*** | (2006.01) |
| ***F24C 15/02*** | (2006.01) |
| ***F24C 7/08*** | (2006.01) |

(52) U.S. Cl.

CPC ..... *H01Q 1/22* (2013.01); *F24C 7/085* (2013.01); *F24C 15/024* (2013.01)

(58) Field of Classification Search

CPC .. H01Q 1/22; H01Q 1/36; H01Q 1/38; H01Q 1/40; H01Q 1/405; H01Q 1/42; F24C 7/08; F24C 15/024; F24C 7/085

USPC ..... 343/700 MS, 702, 720, 767, 789, 872, 343/873

See application file for complete search history.

(56) References Cited

U.S. PATENT DOCUMENTS

| | | | | |
|---|---|---|---|---|
| 4,032,910 | A * | 6/1977 | Hollway | G01R 19/16585 324/95 |
| 5,608,413 | A * | 3/1997 | Macdonald | H01Q 1/243 343/700 MS |
| 5,933,086 | A * | 8/1999 | Tischendorf | E05B 47/0661 340/12.22 |
| 6,054,955 | A * | 4/2000 | Schlegel, Jr. | H01Q 9/42 343/702 |

(Continued)

FOREIGN PATENT DOCUMENTS

| | | | |
|---|---|---|---|
| DE | 20207052 | U1 | 8/2002 |
| DE | 102007005484 | A1 | 7/2008 |

(Continued)

OTHER PUBLICATIONS

International Search Report PCT/EP2012/064392 dated Sep. 14, 2012.

National Search Report DE 10 2011 080 185.5 dated Apr. 13, 2012.

*Primary Examiner* — Brian Young

(74) *Attorney, Agent, or Firm* — Michael E. Tschupp; Andre Pallapies; Brandon G. Braun

(57) ABSTRACT

A domestic appliance includes at least one antenna which is integrated in a handle of the domestic appliance or arranged on a non-conductive wall region. The handle may constitute a door handle, or the at least one antenna may also be integrated in an additional handle of the domestic appliance.

14 Claims, 3 Drawing Sheets

(56) References Cited

U.S. PATENT DOCUMENTS

| | | | | |
|---|---|---|---|---|
| 6,304,168 | B1 * | 10/2001 | Ohta | B60R 25/246 340/5.72 |
| 7,333,021 | B2 * | 2/2008 | Ieda | B60Q 1/2669 340/425.5 |
| 7,679,571 | B2 * | 3/2010 | Inaba | B60R 25/246 343/713 |
| 7,893,884 | B2 * | 2/2011 | Nakamura | H01Q 1/22 343/711 |
| 8,222,578 | B2 | 7/2012 | Beier | |
| 8,526,935 | B2 * | 9/2013 | Besore | H01Q 1/007 455/420 |
| 9,249,606 | B2 * | 2/2016 | Naka | E05B 81/77 |
| 2011/0140972 | A1 * | 6/2011 | Besore | H01Q 1/007 343/702 |

FOREIGN PATENT DOCUMENTS

| | | | |
|---|---|---|---|
| DE | 102008031378 | A1 | 1/2009 |
| DE | 102008029218 | A1 | 12/2009 |
| DE | 102008029230 | A1 | 12/2009 |
| WO | 2010125786 | A1 | 11/2010 |

* cited by examiner

DOMESTIC APPLIANCE HAVING AN ANTENNA

BACKGROUND OF THE INVENTION

The invention relates to a domestic appliance, in particular a large domestic appliance, having at least one antenna.

Domestic appliances with antennas are known, wherein the antennas are attached to an exterior of the domestic appliance as dedicated rod antennas. This creates a disadvantageous optical impression. It is also known to arrange antennas on control circuit boards integrated in the domestic appliance, which however impedes effective data transmission, particularly in domestic appliances with metallic or otherwise electrically conductive outer walls.

BRIEF SUMMARY OF THE INVENTION

The object of the present invention is to at least partly overcome the problems of the prior art and in particular to provide a domestic appliance having an optically unobtrusive option for effective data transmission.

This object is achieved according to the features of the independent claims. Preferred embodiments can be inferred in particular from the dependent claims.

The object is achieved by a domestic appliance having at least one antenna, wherein the at least one antenna is integrated into a handle of the domestic appliance and/or is arranged on a non-conductive wall area.

This domestic appliance is advantageous in that effective data transmission from and/or to the domestic appliance can be achieved in an optically unobtrusive manner, namely in particular also for domestic appliances having metallic side walls. The two variants (a) and (b) represent similar alternatives for achieving the object.

The domestic appliance is in particular an electrical (electrically operated) domestic appliance, in particular large domestic appliance, such as for instance a cooker, an oven, a hob, a refrigerator, a freezer, a chest freezer, a sterilizer, a washing machine, a dishwasher and/or a washer-dryer. The domestic appliance can also be a small domestic appliance, such as a kettle, a toaster etc.

The domestic appliance can in particular comprise a transmitter and/or receiver, in particular transceiver, coupled to the antenna. The transmitter can in particular be configured so as to send sensor data from one or a number of sensors arranged in the domestic appliance. The transmitter, in particular transceiver, can alternatively or in addition be embodied so as to establish a mobile radio link, e.g. to remotely control the domestic appliance or to network the same using a data link. The transmitter can in particular be coupled to a control facility of the domestic appliance.

The antenna can in particular be a monopole or dipole antenna.

The wall area may be in particular an outer wall area of the domestic appliance.

In one embodiment, at least one antenna is integrated into a door handle of the domestic appliance. The domestic appliance can then be equipped with a transmitter without any noticeable change for a user. Since the handle typically also protrudes from the domestic appliance, a very wide-angled radiation characteristic and thus good ability to receive the signals sent by the antenna is made possible.

In another embodiment, at least one antenna is integrated into an additional handle of the domestic appliance, for instance into a front handle for handling and moving the domestic appliance. The antenna may also be integrated into a handle of a kettle etc.

The handle may for instance have an electrically non-conducting surface, e.g. made of plastic, and the antenna can be inserted into the handle. Alternatively, the antenna may be embodied as at least one (electrically conducting) part of the surface of the handle.

In a further embodiment, the at least one antenna is embodied as at least one rod antenna. This can be inserted particularly easily into a typical oblong handle or handle piece or used as a handle.

Another embodiment is that the non-conductive wall area is embodied as at least one recess in a conductive wall area, in particular outer wall area. The at least one antenna can thus also be arranged in other areas which are impermeable for electromagnetic waves. The at least one recess can be embodied in particular in the manner of a slot. The at least one slot-shaped recess can in particular represent part of a slot antenna. Alternatively, a rod antenna, patch antenna etc. may be arranged behind (i.e. on the appliance side) the at least one recess and signals emitted and/or received through the recess.

In another embodiment, the non-conductive wall area is a non-conductive cover, which is permeable for radio waves etc. A continuous surface can thus be retained. The non-conductive cover may consist for instance of glass or plastic.

In one development, an antenna, in particular a patch antenna, is arranged behind (i.e. on the appliance side) of the non-conductive cover.

In a special embodiment, the non-conductive cover is a viewing window (e.g. a transparent cover, a door window etc.) of the domestic appliance. Signals can thus be radiated out of or into a space delimited by the viewing window. In particular, at least one patch antenna may be fastened to the viewing window.

In another special embodiment, the non-conductive cover is a panel cover of the domestic appliance. The panel cover may in particular be used as a viewing window on the display panel disposed therebelow. This allows for radiation even for domestic appliances without any viewing window. In addition, a particularly cost-effective and less complicated option is achieved of outputting and/or receiving signals from the domestic appliance. The panel cover may in particular be a cover of a control panel. Alternatively, the panel can be a decorative cover, in particular for covering boundary areas of a viewing window.

Another embodiment also involves the at least one antenna including at least one patch antenna. The patch antenna has a particularly small installation height, can be fastened in a planar fashion particularly easily and is also cost-effective.

Another embodiment also involves the at least one antenna including at least one slot antenna.

There is a further embodiment in which the domestic appliance has metallic outer walls. The invention is especially useful for such a domestic appliance, since otherwise electromagnetic signals are only transmitted in an optically unobrusive manner with difficulty. Such domestic appliances may include for instance refrigerators, laundry treatment appliances etc.

In another embodiment, the domestic appliance includes an oven, in particular microwave and/or baking oven.

BRIEF DESCRIPTION OF THE DRAWINGS

The invention is described schematically in more detail in the figures below with the aid of exemplary embodiments. In the description the same or similar elements can be provided with the same reference characters for the sake of simplicity.

DETAILED DESCRIPTION OF EXEMPLARY EMBODIMENTS OF THE PRESENT INVENTION

Figure 1:
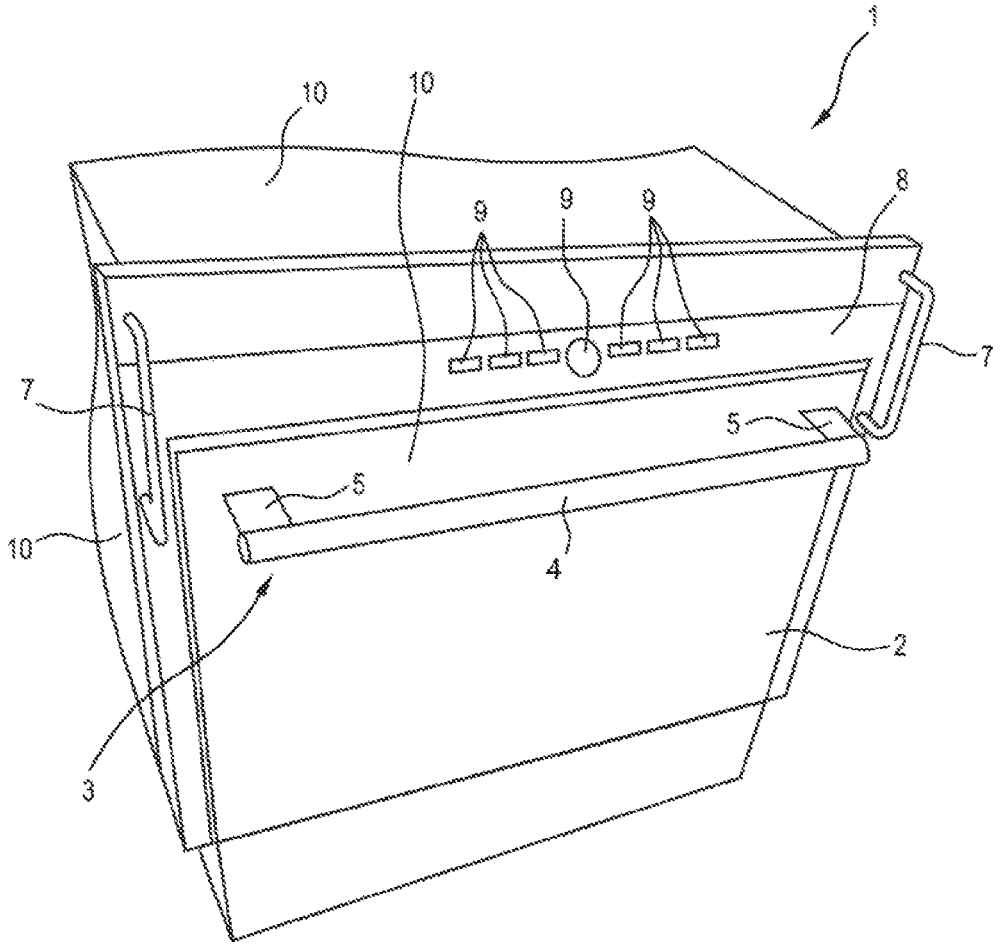
FIG. 1 shows an oblique view of a section of an inventive baking oven according to a first exemplary embodiment.

FIG. 1 shows an oblique view of a section of a domestic appliance in the form of a baking oven 1. The baking oven 1 has metallic outer walls 10, e.g. made of steel plate. The baking oven 1 also has an oven door 2 which opens downwards, on which a door handle 3 is attached with a cylindrical handle piece 4. The oven door 2 may comprise a viewing window, but this is not necessary.

A rod antenna is integrated into the door handle, more precisely into the handle piece 4. This can be done by inserting a dedicated rod antenna into the handle piece 4, wherein a cylindrical outer wall or casing wall of the handle piece 4 is permeable at least in regions in a signal-specific fashion for the rod antenna surrounded by the same. It is however preferred that the outer wall of the handle piece 4 is at least partially electrically conductive and subsequently represents the antenna. Supply lines to the handle piece 4 and/or the antenna accommodated therein can be guided for instance by means of the handle attachments 5 retaining the handle piece 4.

The baking oven 1 also has two additional handles in the form of vertical grab handles 7 on its front side 6. The grab handles 7 may be used for instance to facilitate use of the baking oven 1 in integrated furniture (upper Fig.). An antenna can also be integrated into the grab handle 7 respectively, namely for instance by the electrically conductive grab handles 7 being embodied directly as antennas or by installing a dedicated or separate antenna. The grab handles 7 are embodied here at right angles, but these can also have another position, e.g. aligned horizontally thereto.

The baking oven 1 also has a control panel 8 made of stainless steel, which has a number of control elements 9.

Figure 2:
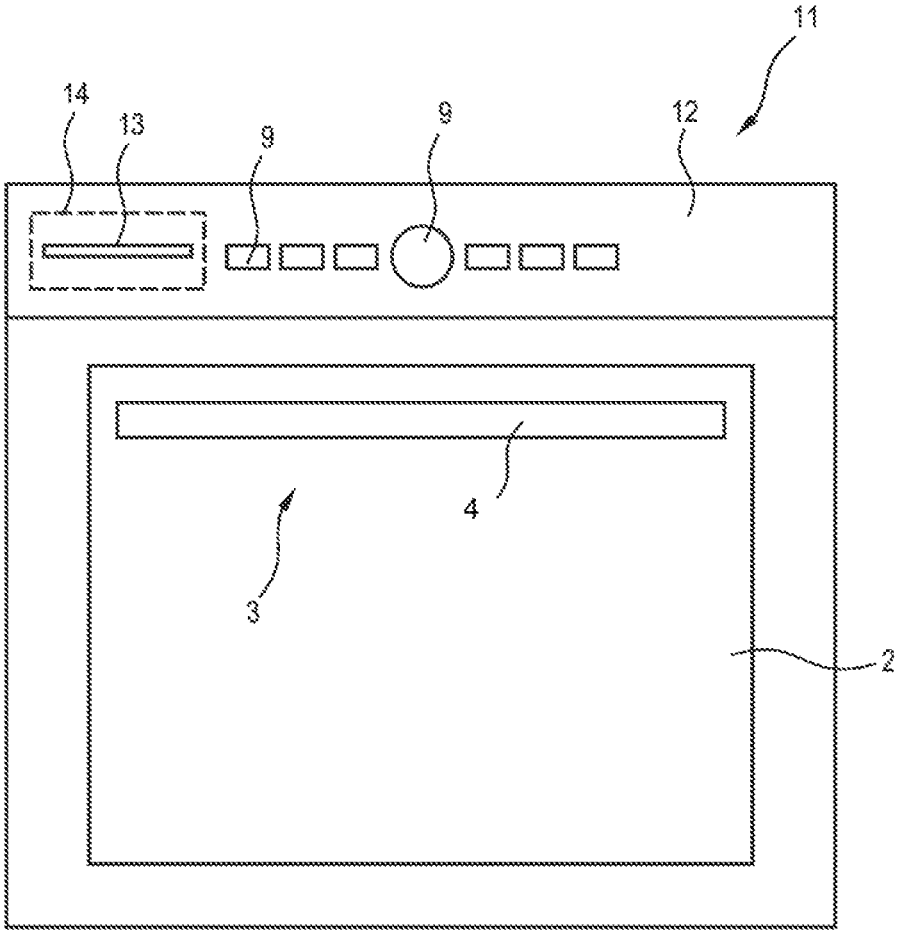
FIG. 2 shows a front view from the front of an inventive baking oven according to a second exemplary embodiment.

FIG. 2 shows a front view from the front of a baking oven 11. The baking oven 11 likewise has a control panel 12 made of stainless steel, which comprises a number of control elements 9. Nevertheless, a slot-shaped recess 13 now exists in the control panel 12, which corresponds to an electrically non-conductive outer wall area. The slot-shaped recess 13 allows electromagnetic waves to pass through, in particular radio waves. The associated antenna 14 can be arranged behind the recess 13. Alternatively, the recess 13 may represent part of a slot antenna.

The baking oven 11 can also have a number of recesses 13. The recess and/or recesses 13 may be in a suitable position, e.g. horizontal, vertical etc.

Figure 3:
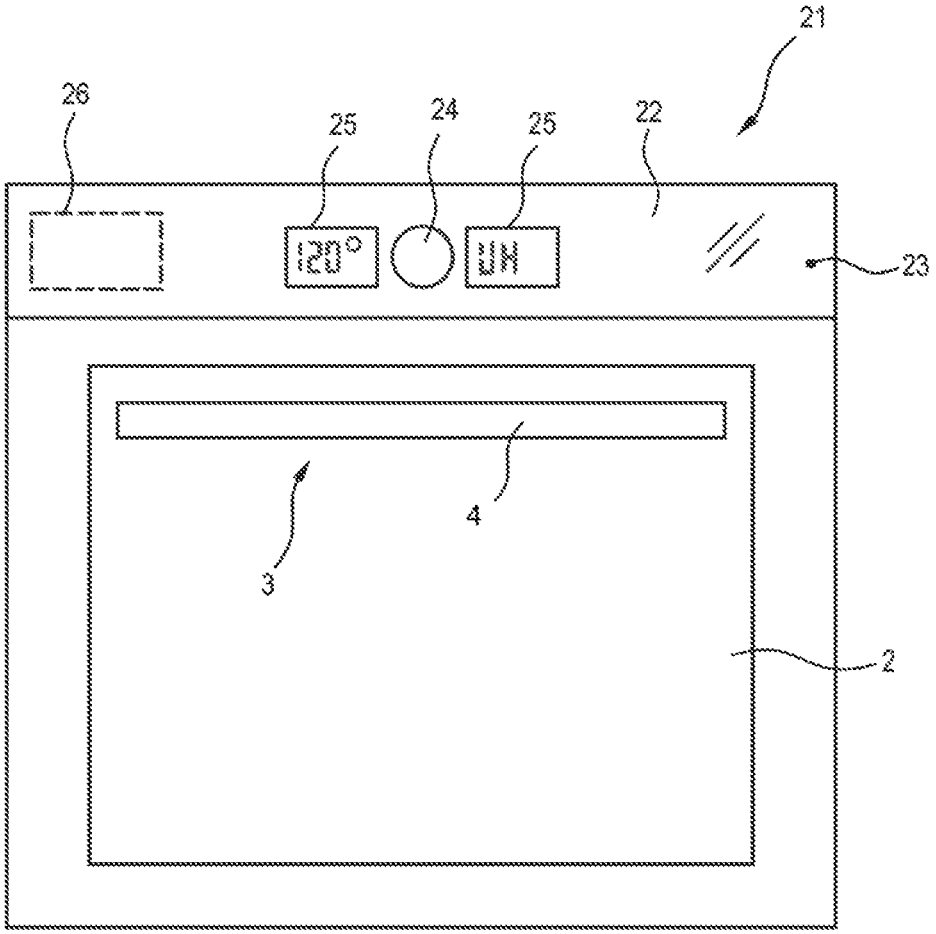
FIG. 3 shows a front view from the front of an inventive baking oven according to a third exemplary embodiment.

FIG. 3 shows a front view from the front of a further baking oven 21. This baking oven 21 has a control panel 22 with an electrically non-conductive outer wall area in the form of a light-permeable front panel 23 made of plastic or glass as a panel cover. A control knob 24 protrudes through the front panel 23. Two display areas 25 are visible through the front panel 23. A thin patch antenna 26 is fastened in a planar fashion behind the front panel 23, for the signals of which the front panel 23 is permeable. The patch antenna 26 can be embodied for instance as a panel antenna with a number of patch fields.

The present invention is naturally not restricted to the exemplary embodiments shown.

Thus the slot-shaped recess may be covered by an electrically non-conductive cover, e.g. a panel cover. For instance, a slot antenna may be present in a metal carrier behind an electrically non-conductive cover.

It is also possible for instance to attach a patch antenna to, in particular behind, a viewing window (electrically non-conductive) in the form of a door window, e.g. a microwave oven, in particular between a glass or plastic disk and a microwave shield. The antenna can also be attached to a door window of a baking oven, e.g. to an intermediate disk or an outer disk of a disk assembly of an oven door.

The invention claimed is:

1. A home kitchen or laundry appliance, comprising:

a space in which a kitchen or laundry function is performed by the home kitchen or laundry appliance;

a handle having an exterior handle surface and an interior space; and an antenna inserted into the interior space of the handle of the home kitchen or laundry appliance.

2. The home kitchen or laundry appliance of claim 1, further comprising a door that closes off the space in which a kitchen or laundry function is performed, wherein the handle is a door handle of the door.

3. The home kitchen or laundry appliance of claim 1, further comprising an additional handle.

4. The home kitchen or laundry appliance of claim 1, wherein the antenna is embodied as a rod antenna.

5. The home kitchen or laundry appliance of claim 1, further comprising an outer wall made of metal.

6. The home kitchen or laundry appliance of claim 1, further comprising an oven.

7. The home kitchen or laundry appliance of claim 6, wherein the oven is a microwave oven or a baking oven.

8. The home appliance of claim 1, wherein the home kitchen or laundry appliance is a cooker, an oven, a hob, a refrigerator, a freezer, a chest freezer, a kettle, a washing machine, a dishwasher, and/or a washer-dryer.

9. The home kitchen or laundry appliance of claim 2, wherein the antenna is embodied as a rod antenna.

10. The home kitchen appliance of claim 1, further comprising a non-conductive wall area.

11. The home kitchen or laundry appliance of claim 10, further comprising a conductive wall area, said non-conductive wall area being embodied as at least one recess in the conductive wall area.

12. The home kitchen or laundry appliance of claim 10, wherein the non-conductive wall area is a non-conductive cover.

13. The home kitchen or laundry appliance of claim 12, wherein the non-conductive cover is configured to provide a viewing window.

14. The home kitchen or laundry appliance of claim 12, wherein the non-conductive cover is configured as a panel cover.

* * * * *